US006085686A

United States Patent [19]

Hemmingson

[11] Patent Number: 6,085,686

[45] Date of Patent: Jul. 11, 2000

[54] TRANSOM TRUNK

[76] Inventor: Rick H. Hemmingson, 52 Bow Meadows Dr., Cochrane, Alberta, Canada, T0L 0W3

[21] Appl. No.: 09/127,957

[22] Filed: Aug. 3, 1998

Related U.S. Application Data

[60] Provisional application No. 60/054,705, Aug. 4, 1997.

[51] Int. Cl.[7] ..... B63B 8/00

[52] U.S. Cl. ..... 114/343; 224/406

[58] Field of Search ..... 114/343, 364, 114/362; 224/328, 400, 401, 406

[56] References Cited

U.S. PATENT DOCUMENTS 4,805,859 2/1989 Hudson ..... 248/148
5,050,526 9/1991 Nelson et al. ..... 114/364
5,599,216 2/1997 Reightley ..... 440/53
5,673,646 10/1997 Knudson ..... 114/343

*Primary Examiner*—Ed Swinehart
*Attorney, Agent, or Firm*—Antony C. Edwards

[57] ABSTRACT

A container and container mounting apparatus for triangulated releasably securable mounting of the container onto a generally horizontal rigid platform on a boat, such as a swim platform, where the platform is adjacent and aft of a transom on the boat. Ski-rope securing eyes for releasable attachment of a ski tow rope to the boat are mounted to the transom of the boat. The container and container mounting apparatus includes a container, sized to stably rest adjacent the transom on the generally horizontal rigid platform, and fasteners for releasably securable mounting of the container to the rigid ski-rope securing eyes.

19 Claims, 13 Drawing Sheets

TRANSOM TRUNK

CROSS REFERENCE TO RELATED APPLICATION

This application claims priority from U.S. Provisional Patent Application Ser. No. 60/054,705 filed Aug. 4, 1997 titled Transom Trunk.

FIELD OF THE INVENTION

This invention relates to storage compartments, coolers, or lockers for power boats, and in particular, to portable storage containers which are releasably mountable onto the swim grid or platform of power boats.

BACKGROUND OF THE INVENTION

The transom trunk of the present invention is intended to satisfy two needs: i) the overall shortage of secure and weatherproof storage recreational boats including so-called runabouts, ski-boats and cruisers; and ii) to provide a place to land and store fish in those same recreational boats and cruisers given the widespread trend toward better interior boat finishes and materials—none of which are designed to accommodate fishing without risk of stains, permanent odors and damage to the interior.

Those who wish to spend some time fishing must usually choose either a more expensive full fiberglass interior option with or without snap-in carpet or buy a boat outfitted for fishing (e.g. live wells, bait wells, fiberglass lined in-floor storage, etc.). The first option is expensive and the latter option means that comfortable tasteful interior design, seating and materials which are intended to accommodate cruising, skiing, family boating and camping are mostly sacrificed.

In the prior art, Applicant is aware of U.S. Pat. No. 4,805,859 which issued Feb. 21, 1989 to Hudson for an Apparatus for Securing Containers to Moving Platforms. Hudson discloses anchoring a tacklebox to a boat by means of a frame upon which are two parallel interlocking rails which mate with corresponding interlocking grooves provided within the tackle box or within an attachment affixed to tackle box's exterior surface. Applicant is also aware of U.S. Pat. No. 5,050,526 which issued Sep. 24, 1991 to Nelson for a Boat Attachment. Nelson teaches an elongated container having a cross section of the approximate cross section of a fishing boat wherein the container has a plurality of straps attached to each end of the elongated container. The straps are adapted, by means of hook brackets, for mounting over each side of the boat gunnel. What is neither taught nor suggested, and that which it is an object of the present invention to provide, is mounting a container onto the aft transom swim platform of, for example, a pleasure boat by using the available triangulated mounting points, namely, the centrally mounted ski tow eye on the upper transom above the swim platform and the lower transversely spaced apart pair of tow eyes mounted to the lower transom of the hull, below the swim platform.

SUMMARY OF THE INVENTION

In summary, the transom trunk of the present invention may be described as a container and container mounting apparatus for triangulated releasably securable mounting of the container onto a generally horizontal rigid platform on a boat, such as a swim platform, where the platform is adjacent and aft of a transom on the boat. A rigid ski-rope securing means, for releasable attachment of a ski tow rope to the boat is mounted to the transom of the boat. The container and container mounting apparatus includes a container, sized to stably rest adjacent the transom on the generally horizontal rigid platform, and, fasteners for releasably securable mounting of the container to the rigid ski-rope securing means.

In the preferred embodiment, where the rigid ski-rope securing means includes an upper ski tow eye mounted on the transom above the platform and a lower transversely spaced apart pair of eyes mounted on the transom below the platform, the means for releasably securable mounting of the container to the rigid ski-rope securing means includes:

(a) a first member securable at a first end thereof to a forward face of the container, and securable at a second end of the first member, opposite the first end of the first member, to the ski tow eye; and, (b) a second member securable at a first end thereof to a rear face of the container, and securable at a second end of the second member, opposite the first end of the second member, to at least one eye of the lower transversely spaced apart pair of eyes.

In one aspect of the present invention, the forward face of the container is rigid, and the first member is a flexible elongate member. The flexible elongate member may be non-resilient in which case it advantageously further comprises a tensioner. Preferrably the tensioner is selectively releasably manually tensionable, for example, from a position standing in the boat adjacent the transom. The flexible elongate member may be a strap.

In a second aspect of the present invention the forward face of the container is rigid, and the first member is a rigid elongate member. Advantageously, the rigid elongate member includes a tensioner, such as a turn-buckle so as to be selectively releasably manually tensionable for example from a position standing in the boat adjacent the transom.

In a preferred embodiment, the first and second members are securable to the forward and rear faces, respectively, of the container by means of anchors mounted to the forward and rear faces, of the container. The anchors may be recessed bars, hooks or eyes mounted into forward and rear walls of the container. Advantageously, the anchors mounted to the forward face include at least one anchor mounted generally centrally on the forward face, and the anchors mounted to the rear face include at least two anchors spaced apart along the rear face so as to be generally adjacent opposite end walls of the container.

In a further aspect, at least one anchor on the front face may be slidably selectively positionable, by selective positioning means, along a vertically disposed track in the forward face. For example, that anchor may be a ring and the selective positioning means a spring biased pin mounted to a ring traveller, where the ring is mounted to the ring traveller. The ring traveller may be slidably mounted in the vertically disposed track so that the spring biased pin engages holes in a vertically spaced apart array of holes in the track.

DETAILED DESCRIPTION OF PREFERRED EMBODIMENTS

Figure 1:
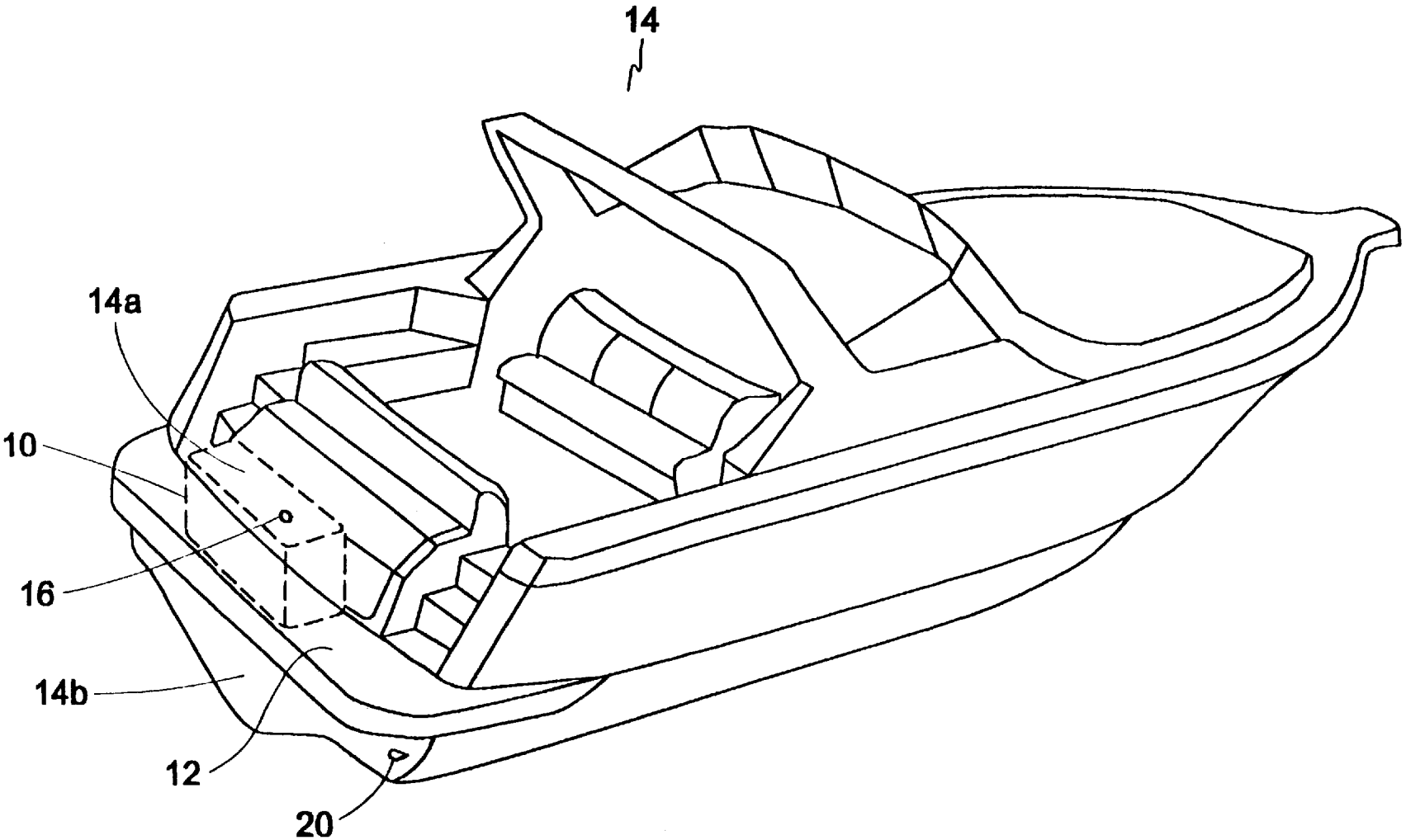
FIG. 1 is, in perspective view, a conventional boat having mounted thereon, and shown in dotted outline, the transom trunk of the present invention.

As illustrated in FIGS. 1–4, the transom trunk of the present invention is a removable trunk 10 removably securable to a swim platform 12. Swim platform 12 is common to many modern boats 14 and protrudes or is cantilevered so as to extend horizontally aft of the upper boat transom 14*a*. Trunk 10 is releasably fastened to swim platform 12 utilizing hardware commonly found on many types of boats, namely, ski tow eye 16 having pin or hook 18, better seen in FIG. 5, and the stern or lower transom hard points such as stem tow eyes 20. Stern hard points such as tow eyes 20 may also be employed to attach a ski tow rope, by means of a bridle, to the boat transom. They may thus also be generically referred to as ski-rope attaching means, and are so referred to herein. The combination of ski tow eye 16 and stern tow eyes 20 provide mounting points for secure triangulated mounting of a container such as trunk 10 onto swim platform 12.

Figure 6:
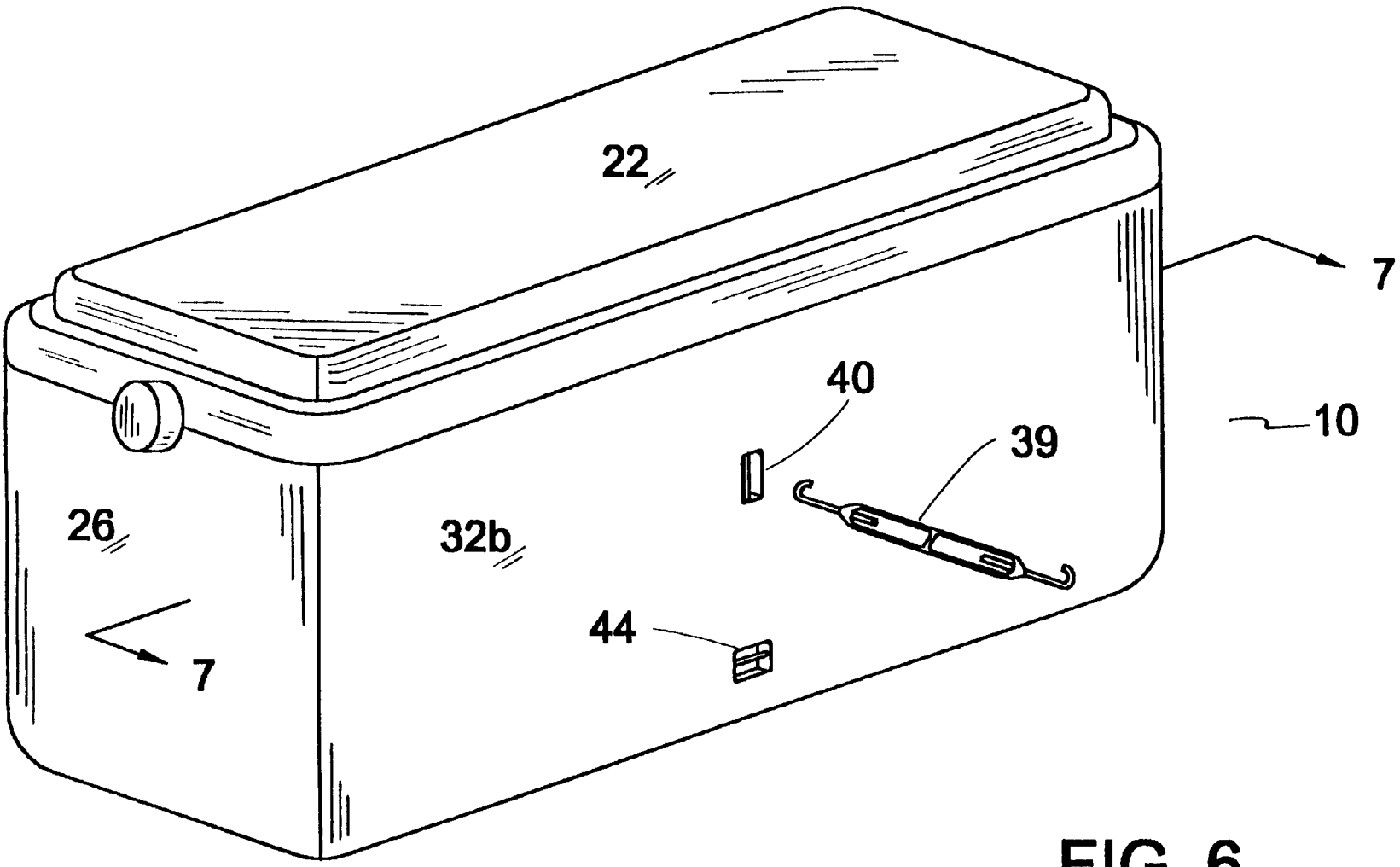
FIG. 6 is, in front perspective view, the transom trunk of FIG. 2, further illustrating one means of securing the transom truck to the ski tow eye.
Figure 7:
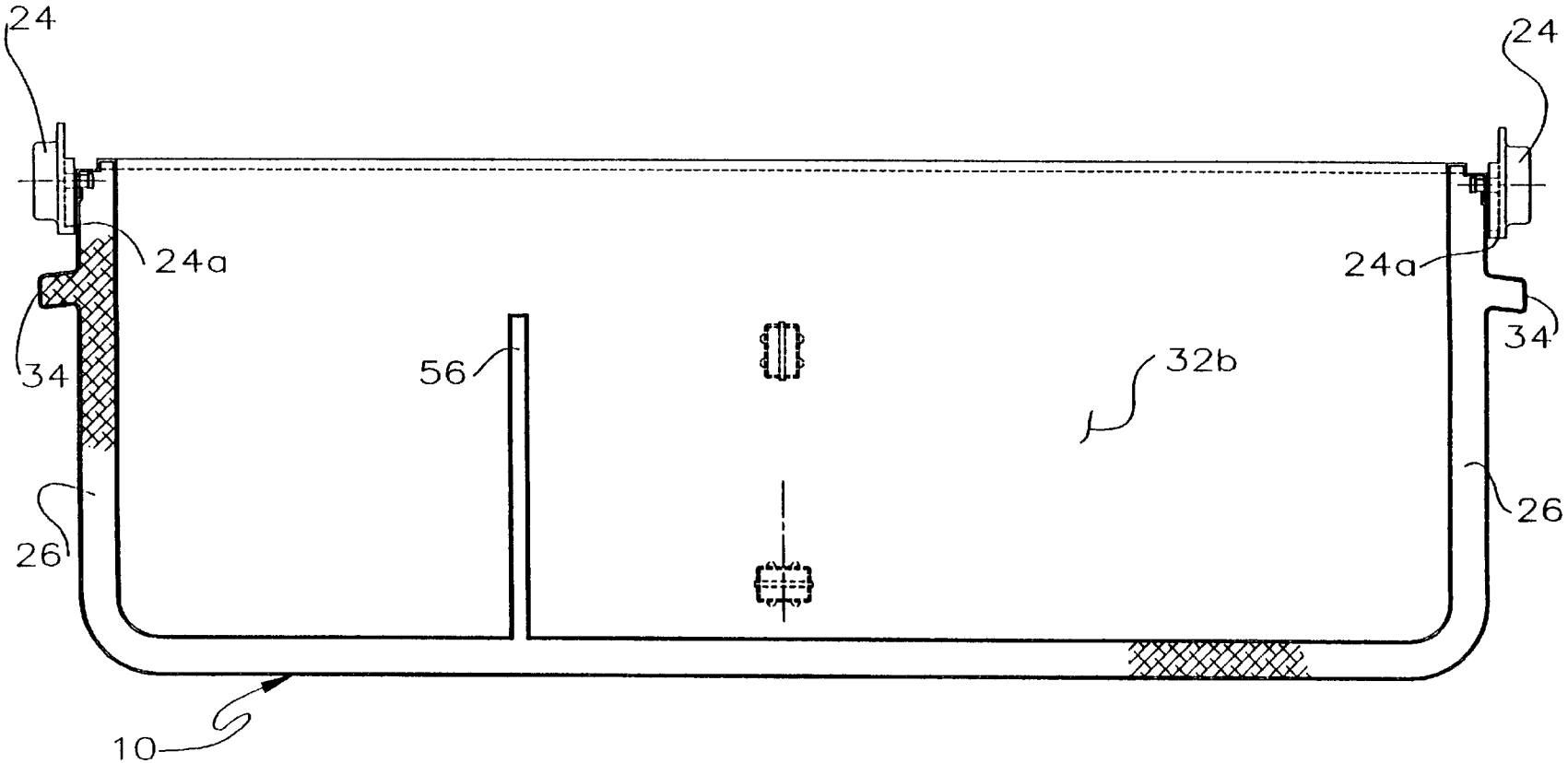
FIG. 7 is a cross-sectional view along line 7—7 in FIG. 6.
Figure 8:
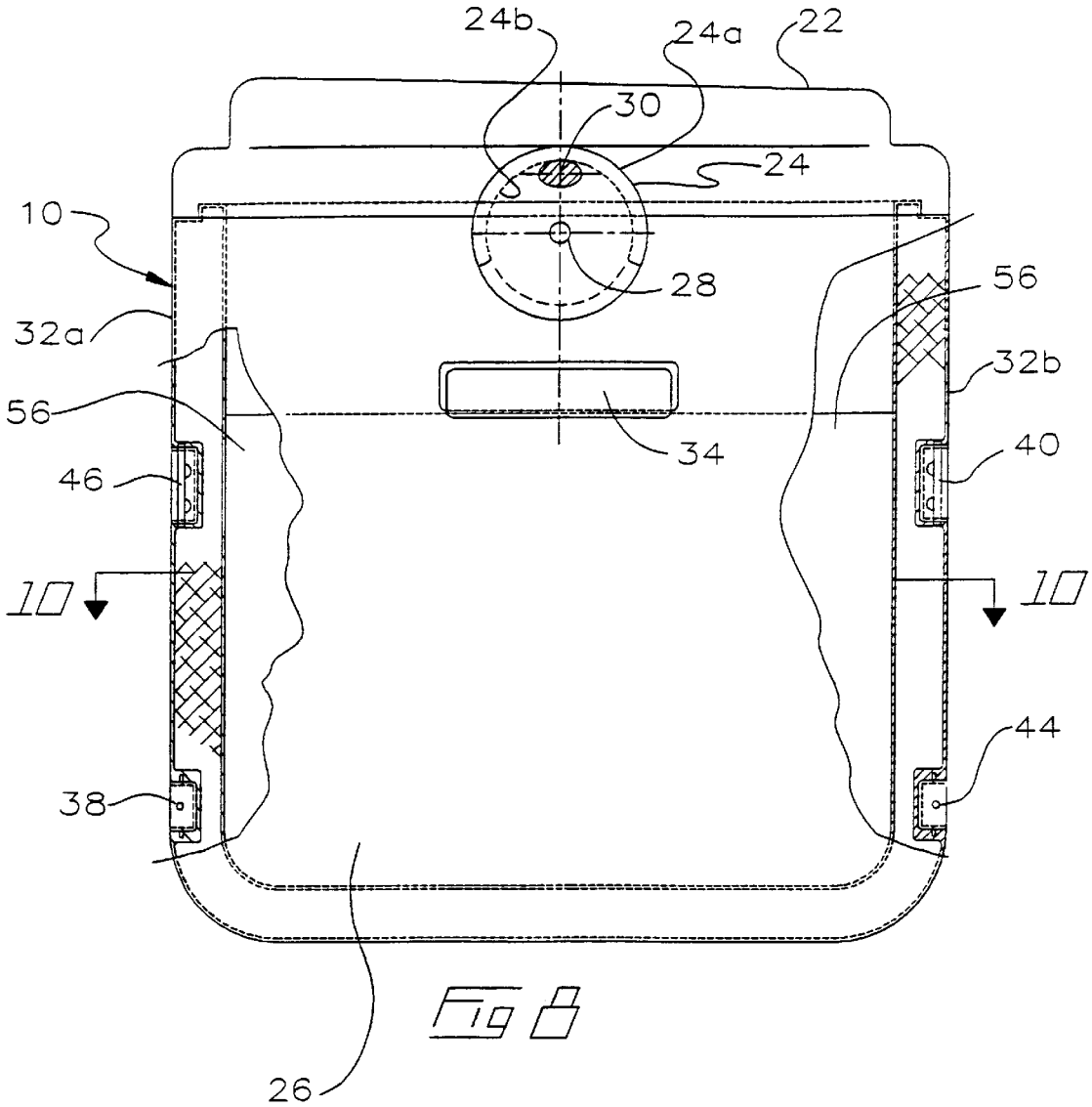
FIG. 8 is a partially cut-away left side end elevation view of the transom trunk of FIG. 6.

Trunk 10 may be constructed out of materials known in the art such as plastic or fiberglass. In the preferred construction the walls, bottom and the cover or lid are insulated by expanding foam core insulation or the like, although insulation is not required. Trunk 10 may have the general external appearance of known types of camping coolers, for example, those manufactured by Coleman™. The lid 22 may be a hinged watertight lid, or, as illustrated, be entirely removable, releasably secured by a rotatable latch 24 mounted onto the upper edge of the end walls 26 of trunk 10 as may be seen in FIGS. 6–8. Rotatable latch 24 has a circumferential rim 24*a*. The inner circumferential surface 24*b*, shown in dotted outline in FIG. 8, of rim 24*a* is offset relative to the pin or shaft 28 by which latch 24 is rotatably mounted to each of end walls 26. Being offset, inner circumferential surface 24*b* acts as a cam surface which, as latch 24 is rotated, frictionally engages cantilevered tab 30 on lid 22. Tab 30 protrudes from the ends of lid 22 so as to extend into the cavity defined by rim 24*a* when lid 22 is mounted onto the upper circumferential edge defined by end walls 26, back wall 32*a* and front wall 32*b*. End walls 26 may have grasp handles 34 mounted thereto.

When trunk 10 is installed, a swim ladder (not shown) and each end of the swim platform 12 remains accessible. The transom storage compartment built into some boats will also be accessible. The object is to avoid using more of the swim platform 12 than is necessary to actually carry trunk 10. Trunk 10 may be finished with non-mar and non-skid plastic or rubber runners (not shown) on the bottom surface of the trunk so that water drains easily under the trunk and slight motion during does not mar the finish on the swim platform.

Trunk 10 may be releasably held in place on swim platform 12 by bungee cords, or, as illustrated, adjustably tensionable ropes or straps 36, or the like, each having a plastic-coated hook or eye at one end that is hooked or looped through the stern tow eyes 20 on lower transom 14*b*. Bungee cords are of course self-tightening due to their resilient nature. Straps 36 may also be resilient, or they may be non-resilient. If non-resilient, a tensioner 37 is advantageous. Many kinds of tensioners are known in the art, for example, a ratchet type tensioner, or an off-center toothed cam with release button similar to conventional boat tie-down straps, or a buckle, perhaps employing a jam cleat or other securing means may be employed. Straps 36, bungee cords or the like attach to back wall 32*a* of trunk 10 by looping through recessed hooks or eyes, or, as illustrated, recessed bars 38 located near the bottom of trunk 10, at opposite ends of back wall 32*a*.

Figure 9:
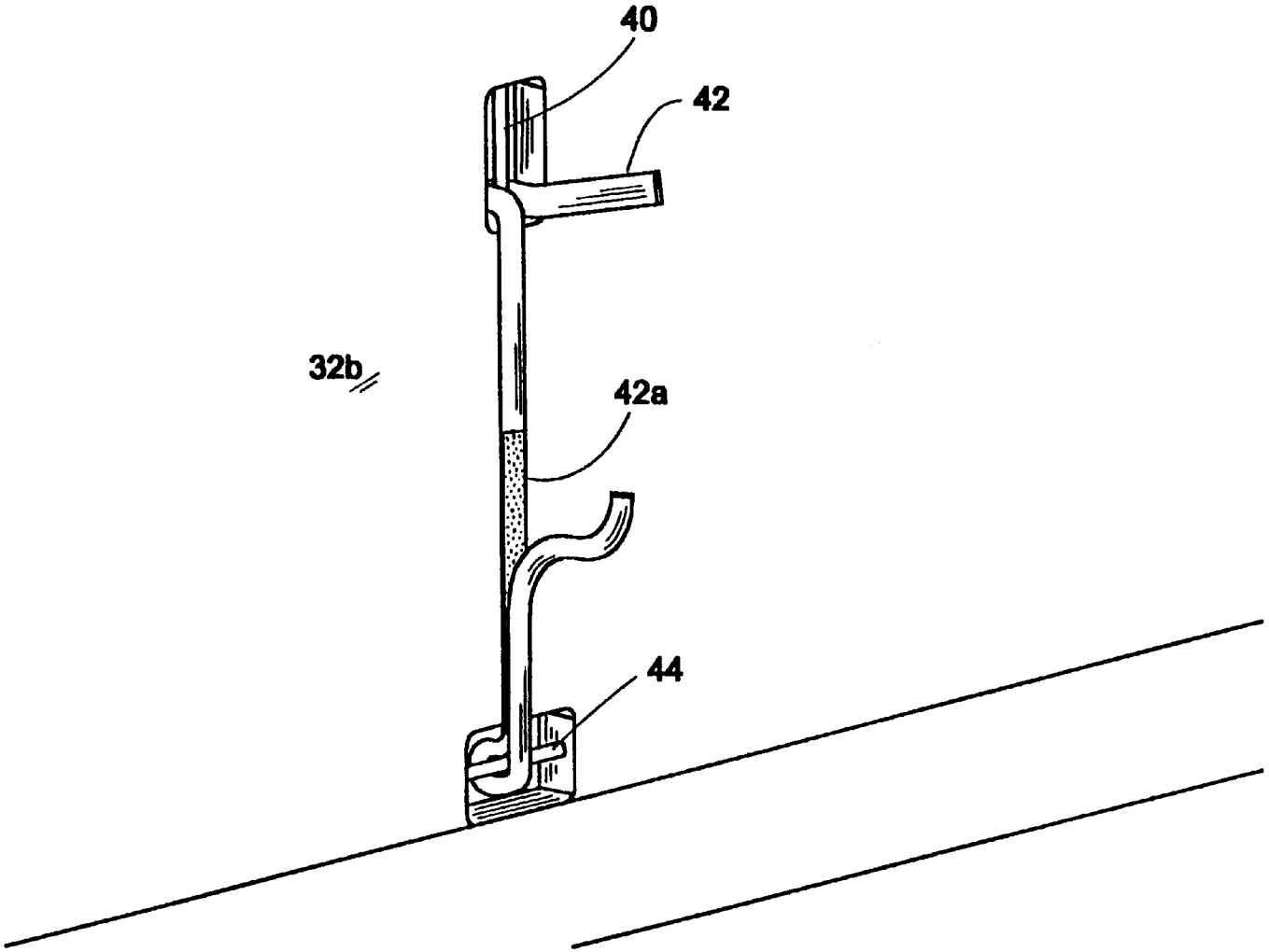
FIG. 9 is, in partial enlarged view, the front wall of the transom trunk of FIG. 6 illustrating an alternative fastening means for fastening the transom trunk to the ski tow eye.

The front wall 32*b* of trunk 10 releasably attaches to ski tow eye 16 using an adjustable releasable fastener. Although not intended to be limiting, as other forms of fasteners fall within the scope of the present invention, types of adjustable releasable fasteners which may be employed include a rigid turn-buckle 39, or a strap 42 such as illustrated in FIG. 9. Strap 42 may for example be releasably tensionable by ratchet tensioners, by pulling an end of the strap through a buckle, the end of the strap releasably secured for example by means of hook and loop fabric fasteners, or the like. Whatever the form of adjustable releasable fastener, one end of the fastener is attached to front wall 32*b*, for example, by means of recessed bar 40 which may also be an eye or hook mounted to, or within front wall 32*b* of trunk 10, and the other end of the fastener is hooked onto or looped over ski tow eye 16, advantageously using pin 18.

When the fastener employed is a strap, such as strap 42, it may be advantageous, to allow for operation of the tensioning device, for a further recessed bar 44 to be mounted into front wall 32*b*. Recessed bar 44 may, as illustrated, be positioned vertically spaced apart beneath recessed bar 40. The strap is attached to ski tow eye 16, passed behind recessed bar 40, and secured to recessed bar 44. Recessed bar 44 is oriented horizontally. Thus, the strap may be tensioned if it is passed behind recessed bar 44 and the free end then pulled upwardly, for example if the fastening means is a length of hook and loop fastener 42*a* to be secured when the strap is folded back on itself between recessed bars 40 and 44 as better seen in FIG. 9.

The upper recessed bars, namely, recessed bar 40 on front wall 32*b* and recessed bars 46 on back wall 32*a*, may, as illustrated be oriented vertically. This is not however intended to be limiting as the bars will be oriented to best suit the form of fastener being employed. Similarly, the lower recessed bars 38 and 44 are illustrated as being horizontal, but again this is not intended to be limiting. It may be that the ends of the straps will be anchored to the lower recessed bars and the upper recessed bars omitted so that, again, the orientation of the lower recessed bars will be dictated by the type of fastener or the type of tensioner as the case may be.

Figure 2:
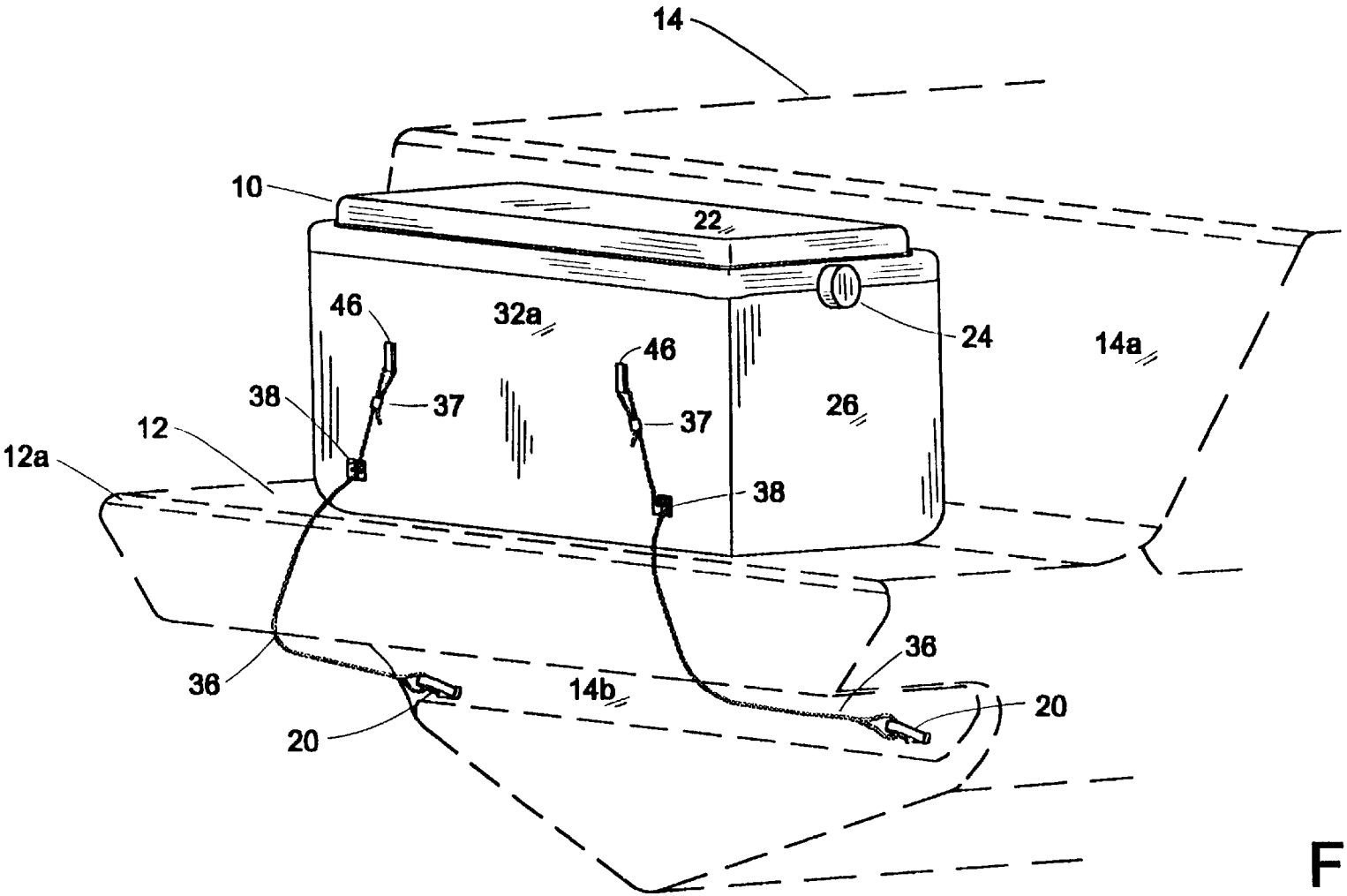
FIG. 2 is, in rear perspective view, the transom trunk of the present invention mounted onto a swim platform.
Figure 3:
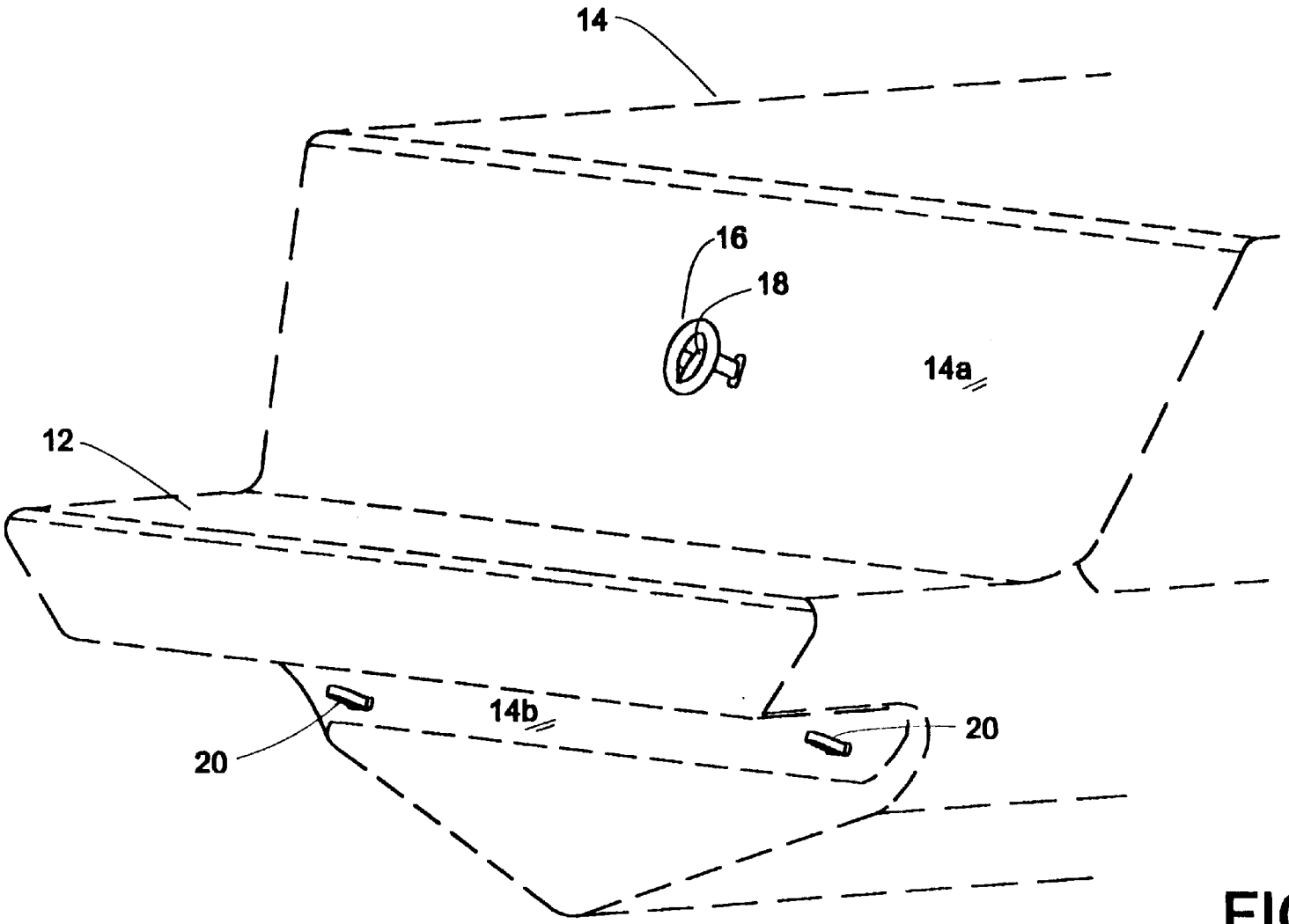
FIG. 3 is, in perspective view, the swim platform and boat transom of FIG. 2.
Figure 4:
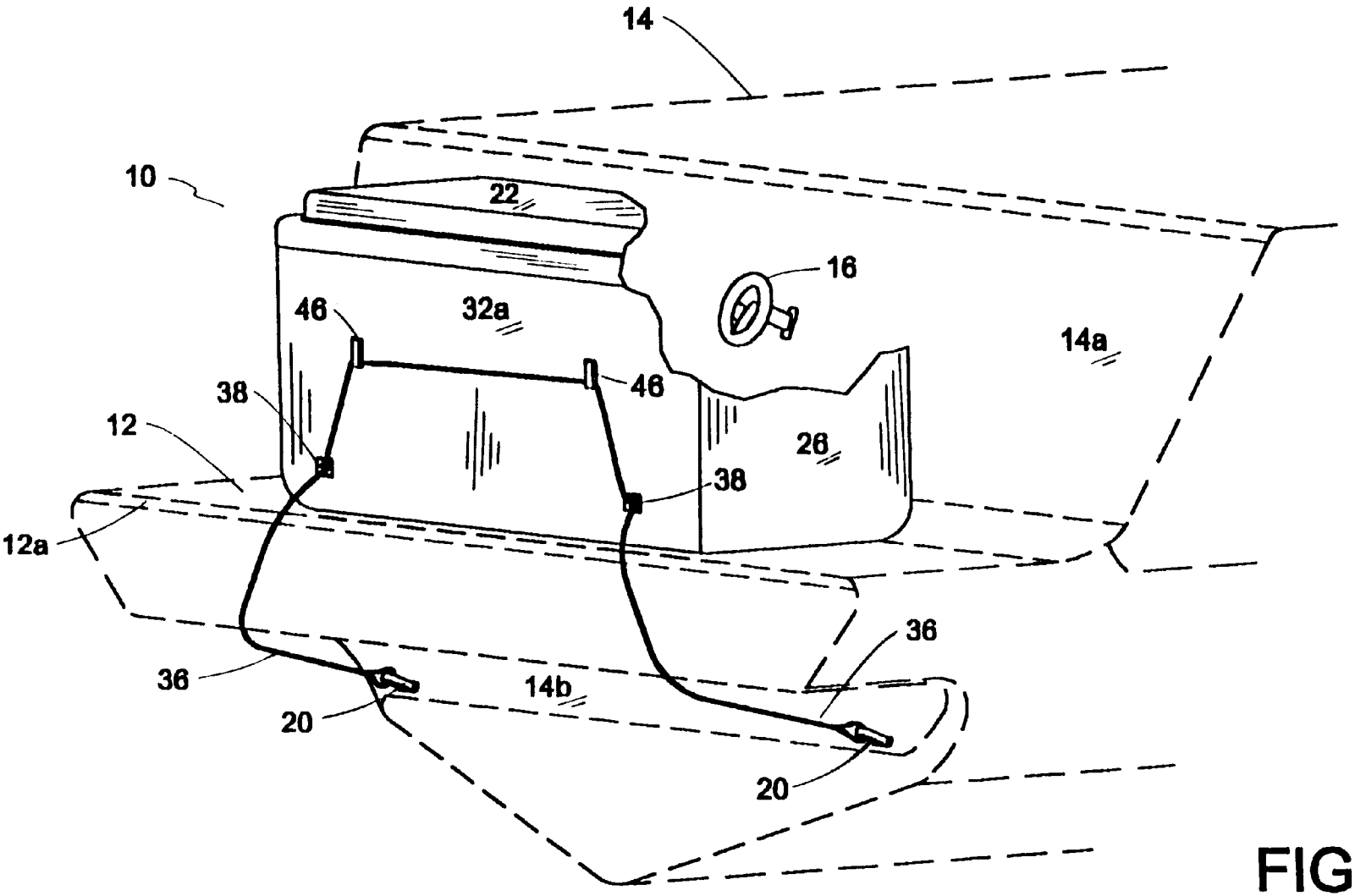
FIG. 4 illustrates, in the view of FIG. 2, the transom trunk of the present invention partially cut away to illustrate the relative position of the transom trunk relative to the ski tow eye.
Figure 5:
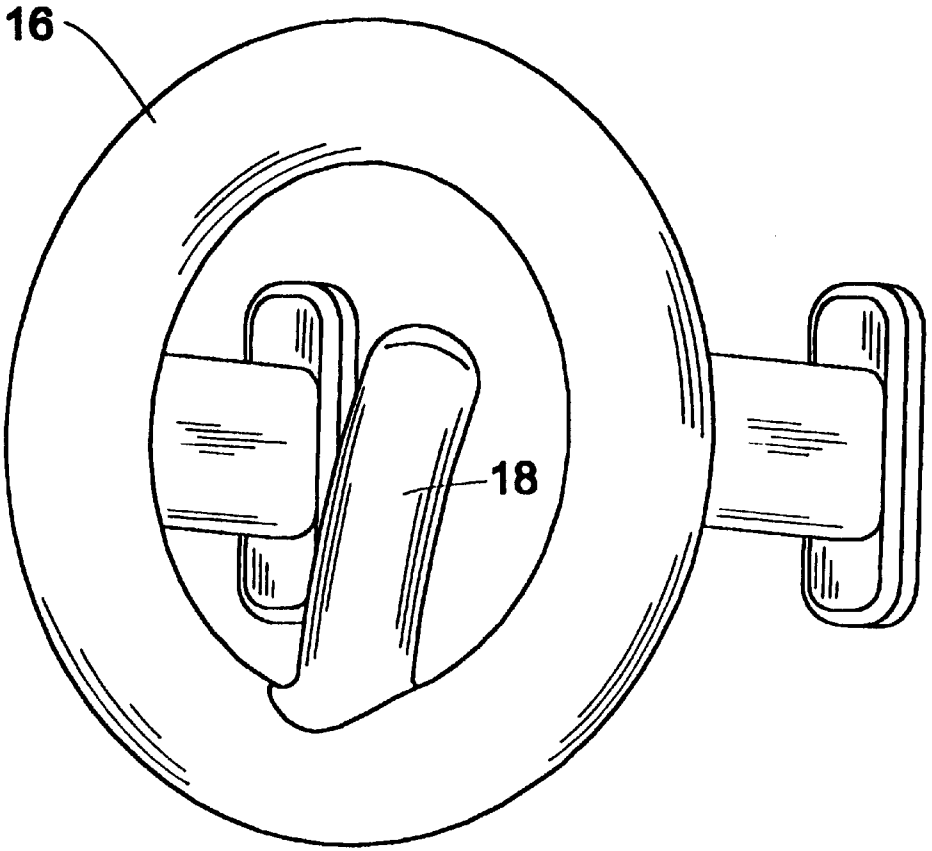
FIG. 5 is, in perspective view, an enlarged view of the ski tow eye.

It may also be that the upper recessed bars 46 are spaced closer together horizontally than are lower recessed bars 38, for example as illustrated in FIGS. 2 and 4. Strap 36 may alternatively be one long continuous piece thread between the horizontally spaced apart upper recessed bars 46 as seen in FIG. 4. Of course the relative positions of the upper and lower recessed bars may be other than as illustrated, for example, they may be vertically oriented one above the other.

It may also be that the upper recessed bars are solely employed, and the lower recessed bars omitted, in applications where the front to back depth of trunk 10 is at least equal to the corresponding front to back depth of swim platform 12. In such an instance lower recessed bars 38 are not required to prevent straps 36 from crossing diagonally from recessed bars 46 to the aft edge 12*a* of the swim platform which, of course, interferes with movement on the swim platform around the trunk. That is, when the front to back depth of trunk 10 is less than the front to back depth of the swim platform, a strap 36 passing diagonally aft from an upper recessed bar 46 to aft edge 12*a* would interfere with and perhaps act to trip a person walking along the aft edge of the swim platform.

Figure 10:
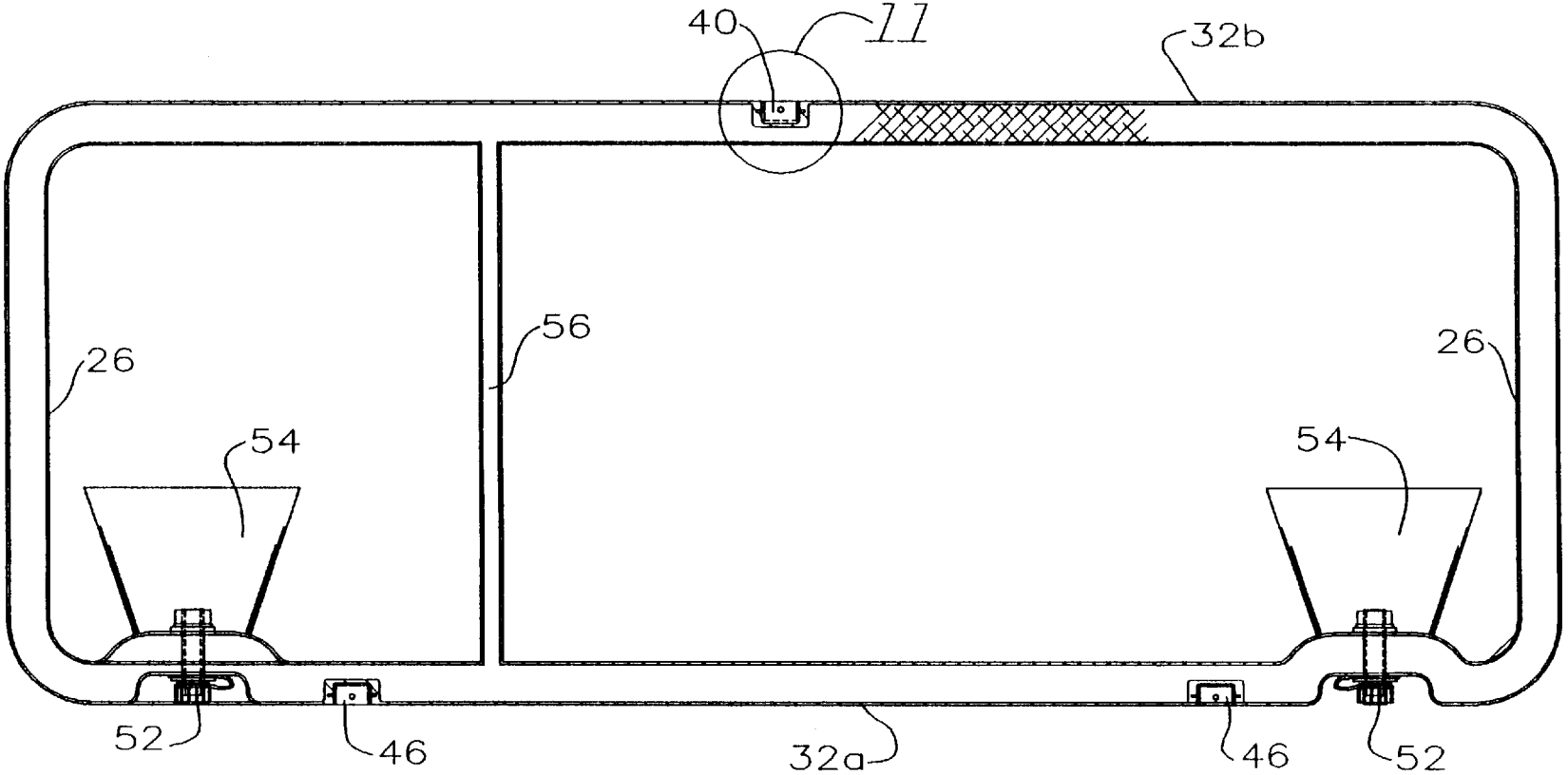
FIG. 10 is a cross-sectional view along line 10—10 in FIG. 8.
Figure 11:
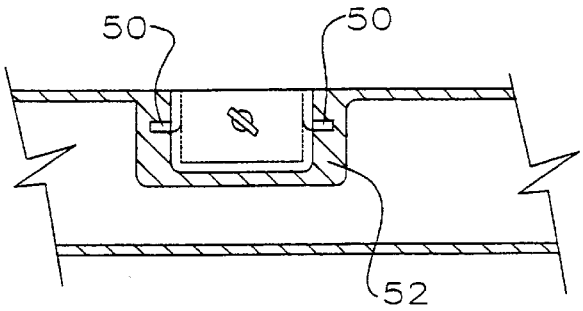
FIG. 11 is, in an enlarged view, a recessed bar and bar housing.
Figure 12:
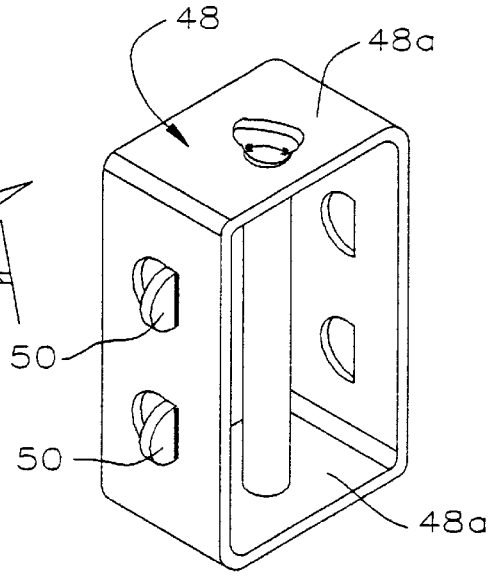
FIG. 12 is, in perspective view, a recessed bar and bar housing.
Figure 12A:
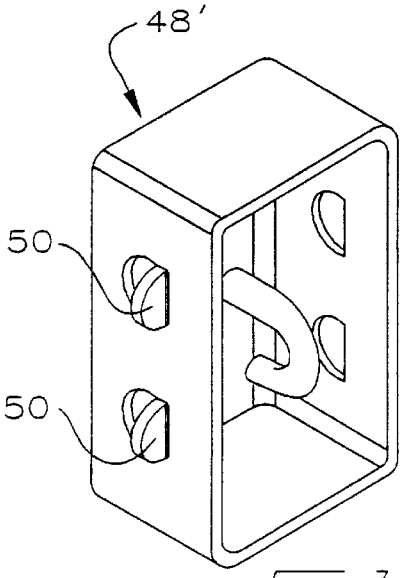
FIG. 12*a* is, in perspective view, a recessed hook and bar housing.
Figure 12B:
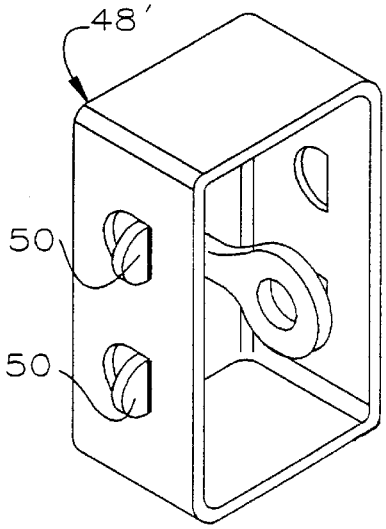
FIG. 12*b* is, in perspective view, a recessed eye and bar housing.

As better understood from FIGS. 10–12, the recessed bars may be rigidly supported within housings 48, for example, journalled between, and through, correspondingly sized apertures in the end walls 48*a* of housings 48. Sections of side walls 48*b* of housings 48 may be turned-out to form tabs or flanges 50 for securing the housings in the molded material 52 of front and back walls 32*b* and 32*a* respectively. FIGS. 12*a* and 12*b* illustrate alternative embodiments where the recessed bars have been replaced with hooks and eyes respectively in housings 48'.

The important aspect of the present invention is that the existing hardware on boat 14 is utilized, and the fastener is easily removable. In the preferred embodiment, no drilling, or mounting of extra hardware or accessories is required. Therefore, the factory finish and water integrity of the swim platform and transom are maintained.

Advantageously, as seen in FIG. 10, drain plugs 52 are installed in trunk 10 at the bottom of trunk 10 so as to face aft when trunk 10 is mounted on swim platform 12 so that excess water, ice melt or wash water can be drained directly overboard. The drain plugs may be recessed into the floor of the trunk to aid draining, for example, by means of downwardly sloped floor surfaces 54. By installing a 12-volt heat pump, motor and/or compressor with an extension cord that plugs into the power points now being offered on many boats, the trunk 10 will act as a long term hot or cold storage box with many possible uses. Trunk 10 can be used for cold or hot storage of foodstuffs, storage of clothing and/or boat gear and marine accessories. Trunk 10 may be compartmentalized by dividing wall 56.

For the fisherman, trunk 10 offers a place to land and keep fish without the necessity of bringing the fish inside the boat. In addition, fish can be kept for long periods of time with ice or ice packs placed inside. A cutting board may be mounted onto, or integrally into, lid 22 to provide a place to clean fish.

When the boat is not moving on the water, trunk 10 can double as a stern seat for fishing and other uses.

Figure 13:
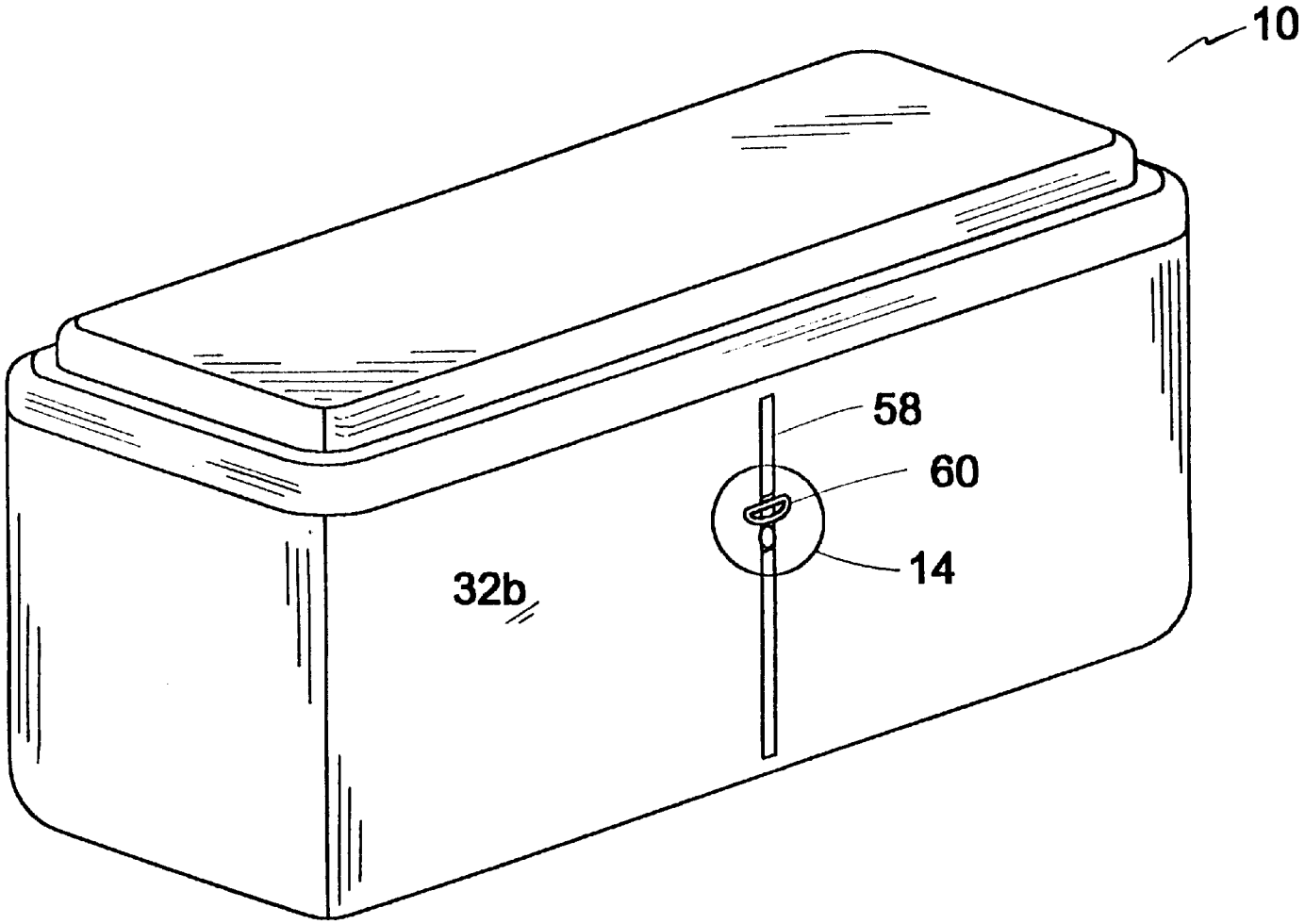
FIG. 13 is, in front perspective view, an alternative embodiment of the transom trunk of the present invention having a tie-down ring slidably mounted in a vertically oriented track.
Figure 14:
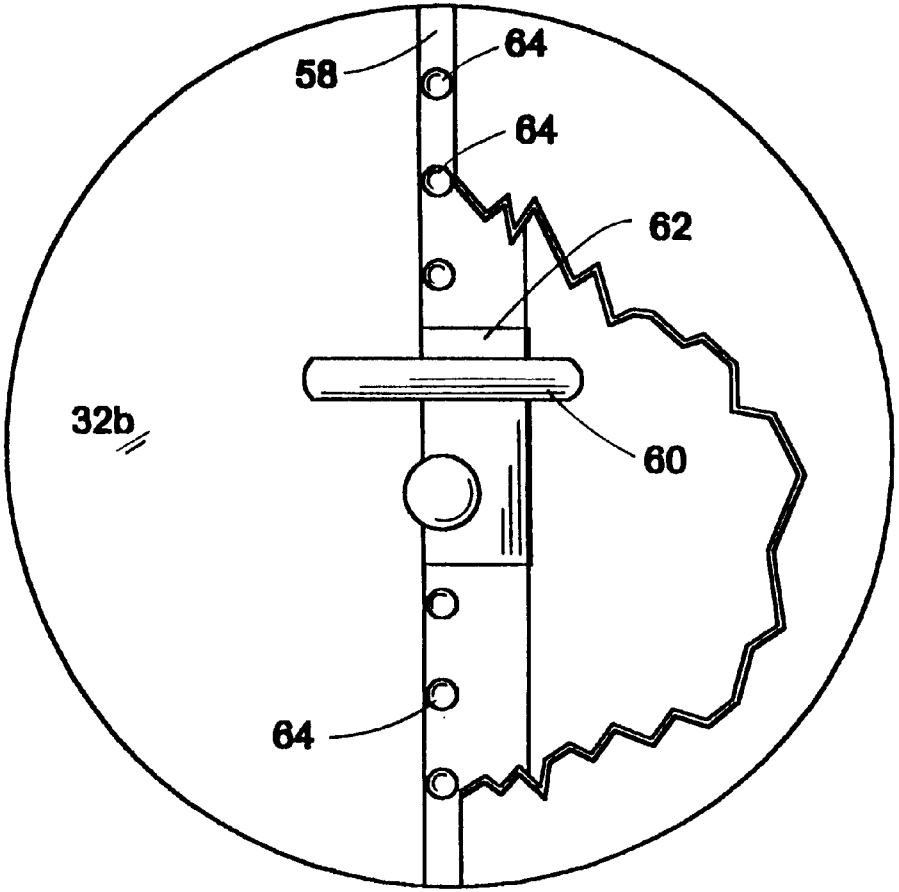
FIG. 14 is an enlarged view of the tie-down ring and vertical track arrangement of FIG. 13.

Unfortunately, the vertical distance between ski tow eye 16 and swim platform 12 varies between different makes of boat. Thus it may be advantageous in an alternative embodiment to provide a vertically oriented, rectangular cross-section slot, as shown in FIGS. 13 and 14, into which may be mounted a tie-down ring 60. Tie-down ring 60 replaces the recessed bars on front wall 32*b*. Tie-down ring 60 may be selectively slidably positioned up or down along slot 58 and held in place by means of a spring-loaded pin 62*a* on the ring traveller 62. Ring 60 is mounted to ring traveller 62. Pin 62*a* mates with vertically spaced apart holes 64 on the back wall of slot 58. When pin 62*a* is pulled outwardly against the return biasing force of a spring (not shown), ring traveller 62 is free to be slid in track 58. Other means may also be employed to selectively releasably lock ring 60 in a desired position along slot 58, for example, a jam or set screw, or an off-center cam design, or any number of commonly used methods of securing the adjustable parts of mechanical fastening devices.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A container and container mounting apparatus for triangulated releasably securable mounting of said container onto a generally horizontal rigid platform on a boat, where said platform is adjacent and aft of a transom on said boat, and where a rigid ski-rope securing means, for releasable attachment of a ski tow rope to said boat is mounted to said transom, said container and container mounting apparatus comprising:

a container sized to stably rest, adjacent said transom on said generally horizontal rigid platform and fasteners for releasably securable mounting of said container to said rigid ski-rope securing means, wherein said rigid ski-rope securing means is an upper ski tow eye mounted on said transom above said platform and a lower transversely spaced apart pair of eyes mounted on said transom below said platform and said means for releasably securable mounting of said container to said rigid ski-rope securing means includes:

(a) a first member securable at a first end thereof to a forward face of said container, and securable at a second end of said first member opposite said first end of said first member, to said ski tow eye; and, (b) a second member securable at a first end thereof to a rear face of said container, and securable at a second end of said second member, opposite said first end of said second member, to at least one eye of said lower transversely spaced apart pair of eyes.

2. The container and container mounting apparatus of claim 1 wherein said forward face of said container is rigid, and wherein said first member is a flexible elongate member.

3. The container and container mounting apparatus of claim 1 wherein said forward face of said container is rigid, and wherein said first member is a rigid elongate member.

4. The container and container mounting apparatus of claim 2 wherein said flexible elongate member is non-resilient and further comprises a tensioner.

5. The container and container mounting apparatus of claim 4 wherein said tensioner is selectively releasably manually tensionable.

6. The container and container mounting apparatus of claim 5 wherein said tensioner is tensionable from a position standing in said boat adjacent said transom.

7. The container and container mounting apparatus of claim 6 wherein said flexible elongate member is a strap.

8. The container and container mounting apparatus of claim 3 wherein said rigid elongate member further comprises a tensioner.

9. The container and container mounting apparatus of claim 8 wherein said rigid elongate member is a turn-buckle.

10. The container and container mounting apparatus of claim 8 wherein said tensioner is selectively releasably manually tensionable.

11. The container and container mounting apparatus of claim 10 wherein said tensioner is tensionable from a position standing in said boat adjacent said transom.

12. The container and container mounting apparatus of claim 1 wherein said first and second members are securable to said forward and rear faces, respectively, of said container by means of anchors mounted to said forward and rear faces, of said container.

13. The container and container mounting apparatus of claim 12 wherein said anchors are recessed bars mounted into forward and rear walls of said container.

14. The container and container mounting apparatus of claim 12 wherein said anchors are hooks mounted into forward and rear walls of said container.

15. The container and container mounting apparatus of claim 12 wherein said anchors are eyes mounted into forward and rear walls of said container.

16. The container and container mounting apparatus of claim 12 wherein said anchors mounted to said forward face include at least one anchor mounted generally centrally on said forward face.

17. The container and container mounting apparatus of claim 12 wherein said anchors mounted to said rear face include at least two anchors spaced apart along said rear face so as to be generally adjacent opposite end walls of said container.

18. The container and container mounting apparatus of claim 16 wherein said at least one anchor is slidably selectively positionable, by selective positioning means, along a vertically disposed track in said forward face.

19. The container and container mounting apparatus of claim 18 wherein said at least one anchor is a ring and said selective positioning means is a spring biased pin mounted to a ring traveller, said ring mounted to said ring traveller, said ring traveller slidably mounted in said vertically disposed track, said spring biased pin for engaging holes in a vertically spaced apart array of holes in said track.

* * * * *